US008395566B2

(12) United States Patent
Lee et al.

(10) Patent No.: US 8,395,566 B2
(45) Date of Patent: Mar. 12, 2013

(54) METHOD OF DRIVING ELECTROPHORETIC DISPLAY

(75) Inventors: Cheng-Hao Lee, HsinChu (TW); Hsin-Chung Chen, HsinChu (TW)

(73) Assignee: E Ink Holdings Inc., Hsinchu County (TW)

( * ) Notice: Subject to any disclaimer, the term of this patent is extended or adjusted under 35 U.S.C. 154(b) by 767 days.

(21) Appl. No.: 12/352,835

(22) Filed: Jan. 13, 2009

(65) Prior Publication Data

US 2010/0085284 A1 Apr. 8, 2010

(30) Foreign Application Priority Data

Oct. 2, 2008 (TW) ..... 97138003 A

(51) Int. Cl.
*G09G 3/30* (2006.01)

(52) U.S. Cl. ..... 345/77

(58) Field of Classification Search ..... None
See application file for complete search history.

(56) References Cited

U.S. PATENT DOCUMENTS 6,057,809 A * 5/2000 Singhal et al. ..... 345/3.3
7,362,294 B2 * 4/2008 Liang et al. ..... 345/89

* cited by examiner

*Primary Examiner* — K. Wong
(74) *Attorney, Agent, or Firm* — Chun-Ming Shih

(57) ABSTRACT

A method of driving an electro-optic display includes the following steps. First, a first frame is displayed on pixels at a first time. Next, data of a second frame predetermined to be displayed on the pixels at a second time later than the first time is determined. Next, an eliminating frame showing a first extreme gray level or a second extreme gray level is displayed on the pixels at a third time. Afterwards, a medium frame is displayed on the pixels at a fourth time later than the third time. The third and fourth times are between the first and second times. The gray level shown by each pixel at the fourth time is close to the gray level predetermined to be shown by the same pixel at the second time. Thereafter, the second frame is displayed on the pixels at the second time.

4 Claims, 13 Drawing Sheets

METHOD OF DRIVING ELECTROPHORETIC DISPLAY

BACKGROUND

1. Field of the Invention

The present invention relates to a driving method, and more particularly, to a method of driving an electro-optic display.

2. Description of the Related Art

FIG. 1 is a schematic cross-sectional view of a conventional electrophoretic display. FIG. 2 is a flow chart of a conventional method of driving the electrophoretic display of FIG. 1. FIG. 3A is a schematic view of a first frame displayed by the electrophoretic display of FIG. 1 at a first time. FIG. 3B is a schematic view of a second frame displayed by the electrophoretic display of FIG. 1 at a second time. Referring to FIG. 1, the electrophoretic display 100 includes a plurality of pixels 110 adapted to displaying frames. The electrophoretic display 100 has an electrophoretic layer 120 including a plurality of microcapsules 122 and the electrophoretic fluid 124 filling in each of the microcapsules 122. The electrophoretic fluid 124 filling in each of the microcapsules 122 includes the dielectric solvent 124*a* and a plurality of charged pigment particles 124*b* dispersed in the dielectric solvent 124*a*.

The conventional method of driving the electrophoretic display includes the following steps. Firstly, referring to FIGS. 1, 2 and 3A, the step 101 is performed. The step 101 is that a first frame F11 is displayed on the pixels 110 at a first time. Then, referring to FIGS. 1, 2 and 3B, the step 102 is performed. The step 102 is that a second frame F12 is displayed on the pixels 110 at a second time later than the first time. When the electrophoretic display 100 displays the first frame F11 or the second frame F12, part of the charged pigment particles 124*b* in each of the microcapsules 122 move to a side of the electrophoretic display 100 such that the first frame F11 or the second frame F12 is displayed.

However, the dielectric solvent 124*a* is viscous such that the moving speed of each of the charged pigment particles 124*b* is limited. Thus, when the step 101 and the step 102 are preformed according to the conventional method of driving the electrophoretic display, a ghost image (the diagonal lines as shown in FIG. 3B) of the first frame F11 appears at the second frame F12 displayed by the electrophoretic display 100.

To solve the above problem, another conventional method of driving the electrophoretic display is provided. FIG. 4 is a flow chart of another conventional method of driving the electrophoretic display of FIG. 1. FIG. 5A is a schematic view of a first frame displayed by the electrophoretic display of FIG. 1 at a first time. FIG. 5B is a schematic view of a black frame displayed by the electrophoretic display of FIG. 1 at a second time. FIG. 5C is a schematic view of a white frame displayed by the electrophoretic display of FIG. 1 at a third time. FIG. 5D is a schematic view of a second frame displayed by the electrophoretic display of FIG. 1 at a fourth time. Another conventional method of driving the electrophoretic display includes the following steps. Firstly, referring to FIGS. 1, 4 and 5A, the step 201 is performed. The step 201 is that a first frame F21 is displayed on the pixels 110 at a first time. Then, referring to FIGS. 1, 4 and 5B, the step 202 is performed. The step 202 is that a black frame F22 is displayed on the pixels 110 at a second time later than the first time. Next, referring to FIGS. 1, 4 and 5C, the step 203 is performed. The step 203 is that a white frame F23 is displayed on the pixels 110 at a third time later than the second time. Finally, referring to FIGS. 1, 4 and 5D, the step 204 is performed. The step 204 is that a second frame F24 is displayed on the pixels 110 at a fourth time later than the third time. However, according to anther conventional method of driving the electrophoretic display, the above four steps must be performed in order to switch from the first frame F21 to the second frame F22. Therefore, when a user views the electrophoretic display 100, the user will feel uncomfortable due to the extreme black-and-white twinkle during switching the frames.

BRIEF SUMMARY

The present invention is directed to provide a method of driving an electro-optic display which can reduce the user's uncomfortable feel during switching frames.

A method of driving an electro-optic display in accordance with an embodiment of the present invention is provided. The electro-optic display has a plurality of pixels. Each of the pixels is adapted to displaying a plurality of gray levels. A group composed of the gray levels includes a first extreme gray level, a plurality of intermediate gray levels and a second extreme gray level. The driving method comprises the following steps. Firstly, a first frame is displayed on the pixels at a first time. Then, data of a second frame is determined. The second frame is predetermined to be displayed on the pixels at a second time, and the second time is later than the first time. Next, an eliminating frame is displayed on the pixels at a third time. The third time is between the first time and the second time. The eliminating frame is the next one frame posterior to the first frame, and the eliminating frame shows the first extreme gray level or the second extreme gray level.

Afterwards, a first medium frame is displayed on the pixels at a fourth time. The fourth time is between the third time and the second time. The first medium frame is the preceding one frame prior to the second frame. The gray level shown by each of the pixels at the fourth time is close to the gray level predetermined to be shown by the same pixel at the second time. Afterwards, the second frame is displayed on the pixels at the second time.

In an embodiment of the present invention, the amount of the pixels is 4N, and N is a positive integer. The gray level shown by each of the pixels at the fourth time is one of the preceding N levels or one of the next N levels from the gray level shown by the same pixel at the second time. In addition, the above method of driving the electro-optic display further comprises the following step. A second medium frame is displayed on the pixels at a fifth time. The fifth time is between the third time and the fourth time. The second medium frame is the preceding one frame prior to the first medium frame. The gray level shown by each of the pixels at the fifth time is one of the preceding N levels or one of the next N levels from the gray level shown by the same pixel at the fourth time. Each of the pixels at the fifth time does not show the first extreme gray level or the second extreme gray level.

In an embodiment of the present invention, the above method of driving the electro-optic display further comprises the following step. A second medium frame is displayed on the pixels at a fifth time. The fifth time is between the third time and the fourth time. The second medium frame is the preceding one frame prior to the first medium frame. The gray level shown by each of the pixels at the fourth time is between the gray level shown by the same pixel at the fifth time and the gray level shown by the same pixel at the second time. Each of the pixels at the fifth time does not show the first extreme gray level or the second extreme gray level.

Since the gray level shown by each of the pixels at the fourth time is close to the gray level predetermined to be shown by the same pixel at the second time, compared with the conventional art, the method of driving the electro-optic display of the present embodiment can reduce the user's uncomfortable feel related to the extreme twinkle during switching from the first frame to the second frame.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Reference will now be made to the drawings to describe exemplary embodiments of the present driving method, in detail. The following description is given by way of example, and not limitation.

Figure 1:
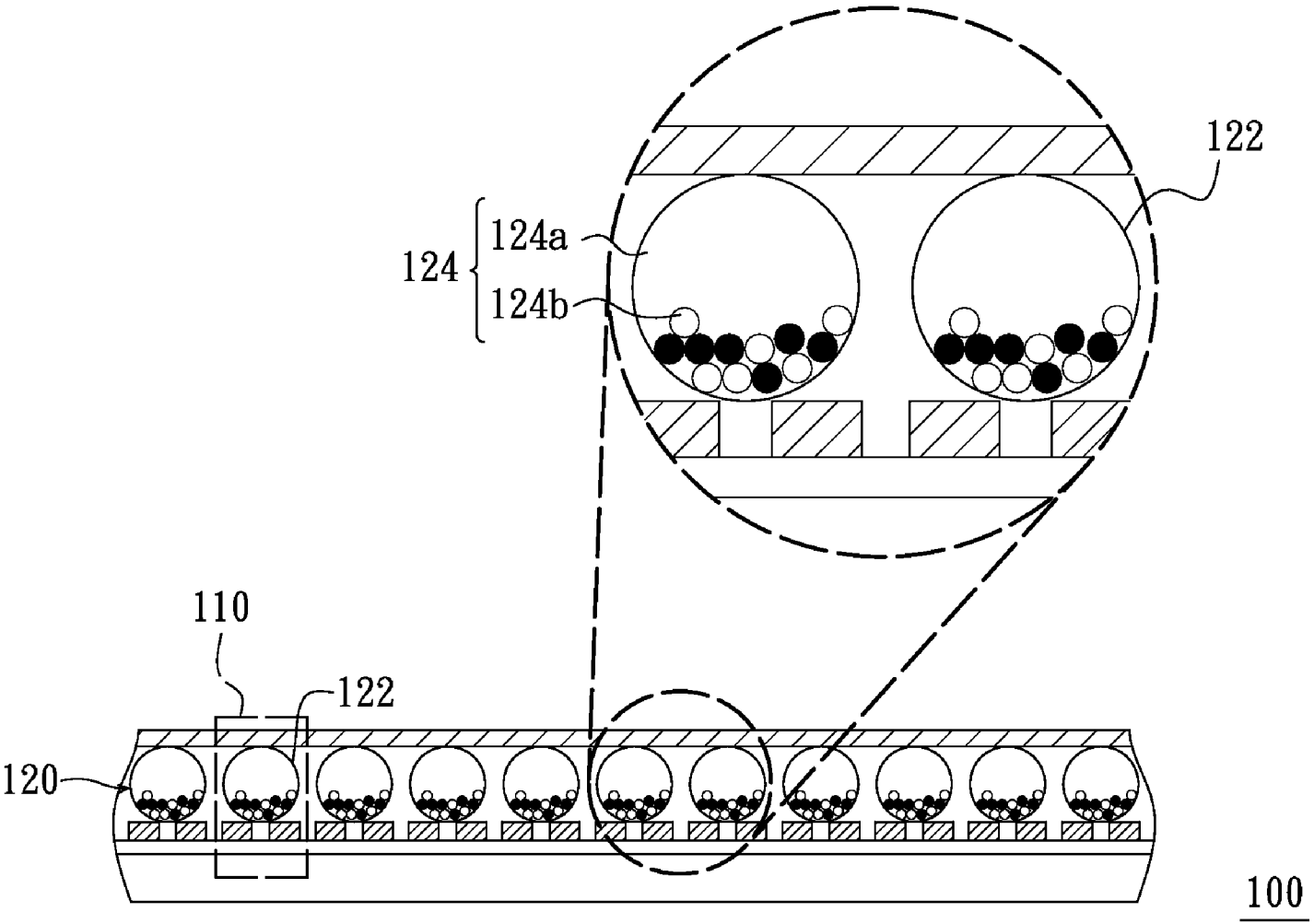
FIG. 1 (Prior Art)
FIG. 1 is a schematic cross-sectional view of a conventional electrophoretic display.
Figure 2:
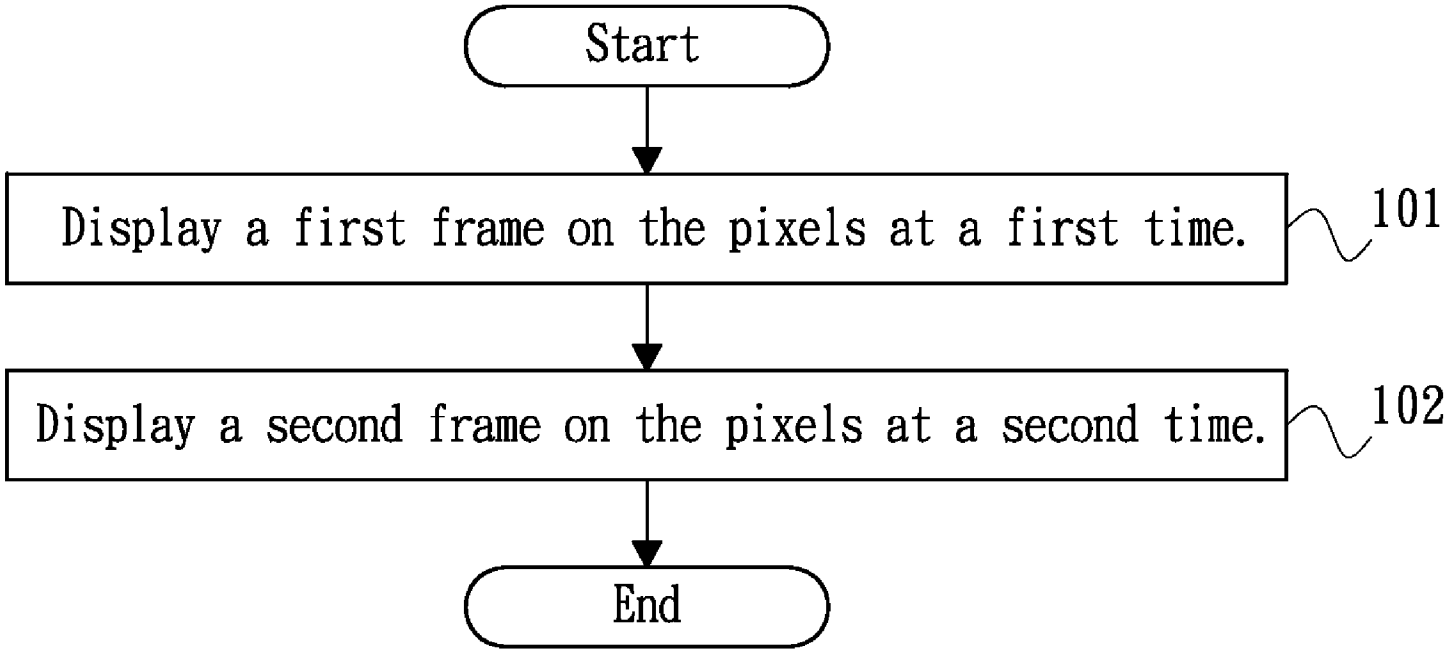
FIG. 2 (Prior Art)
FIG. 2 is a flow chart of a conventional method of driving the electrophoretic display of FIG. 1.
Figure 3B:
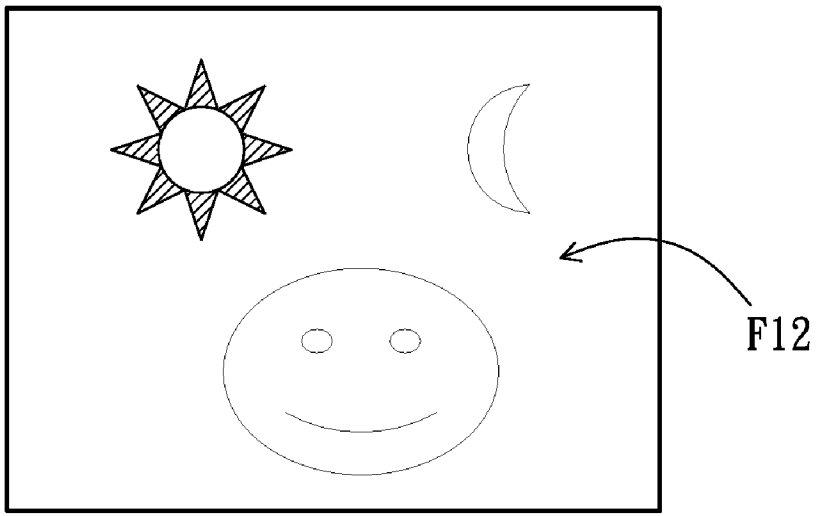
FIG. 3B (Prior Art)
FIG. 3B is a schematic view of a second frame displayed by the electrophoretic display of FIG. 1 at a second time.
Figure 3A:
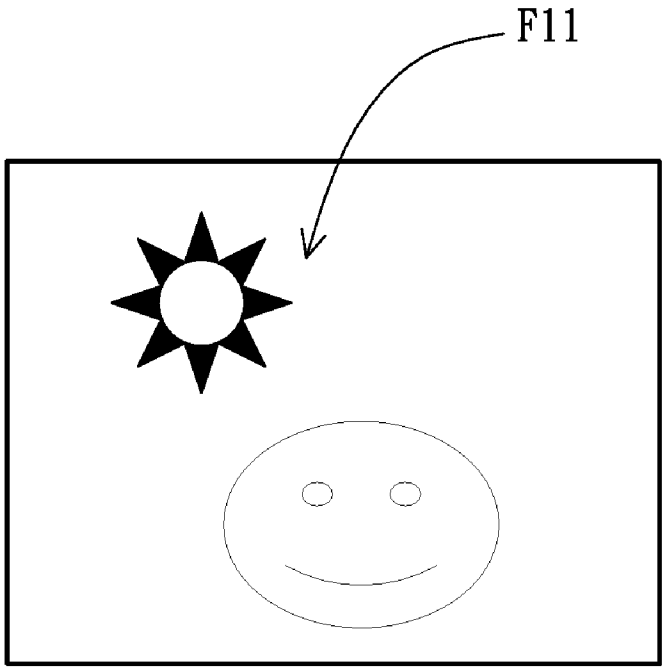
FIG. 3A (Prior Art)
FIG. 3A is a schematic view of a first frame displayed by the electrophoretic display of FIG. 1 at a first time.
Figure 4:
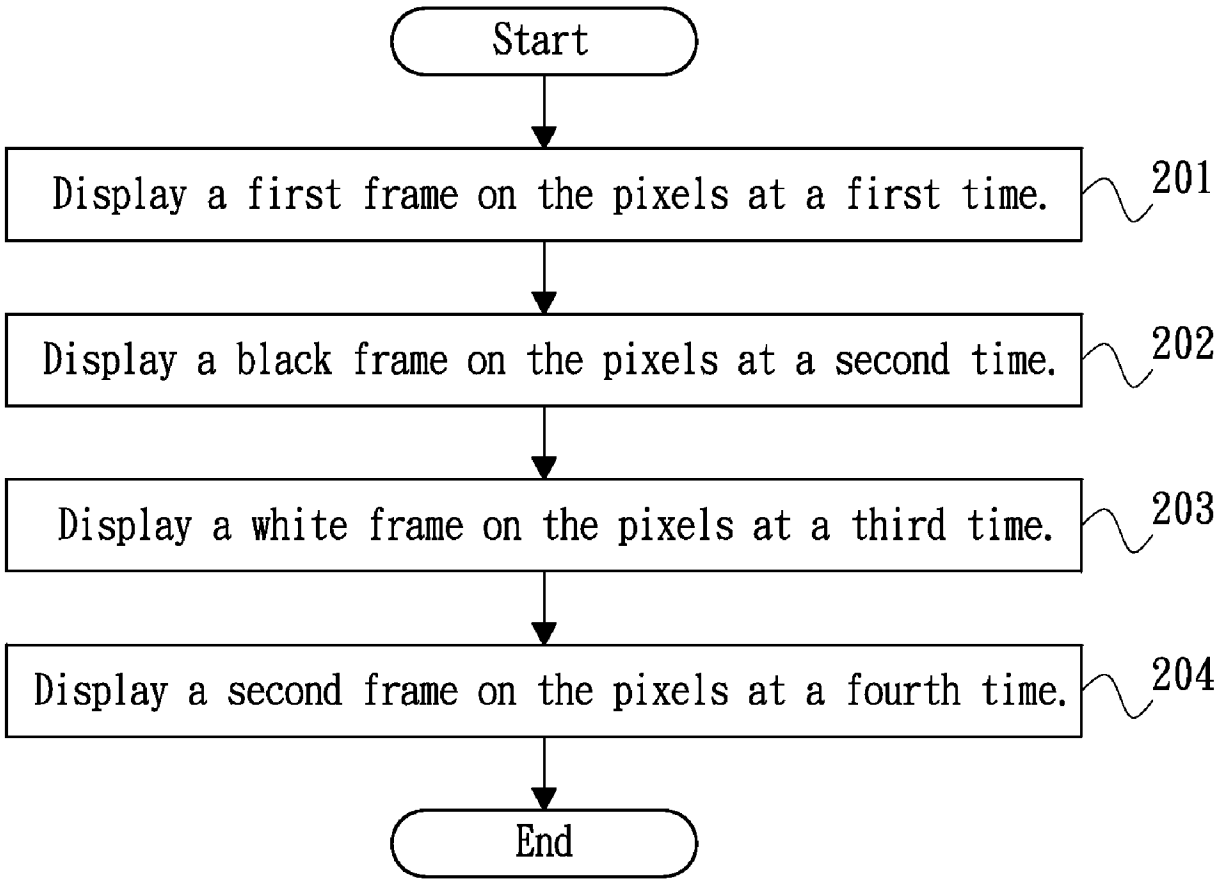
FIG. 4 (Prior Art)
FIG. 4 is a flow chart of another conventional driving method for the electrophoretic display of FIG. 1.
Figure 5A:
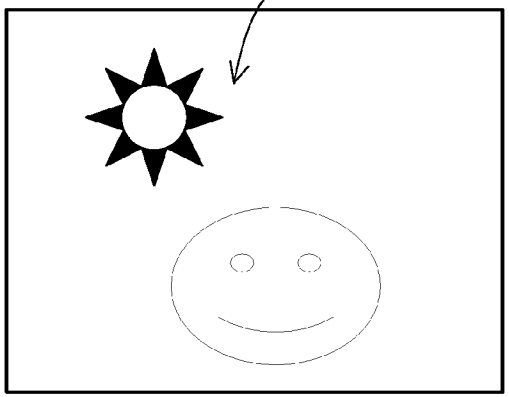
FIG. 5A (Prior Art)
FIG. 5A is a schematic view of a first frame displayed by the electrophoretic display of FIG. 1 at a first time.
Figure 5B:
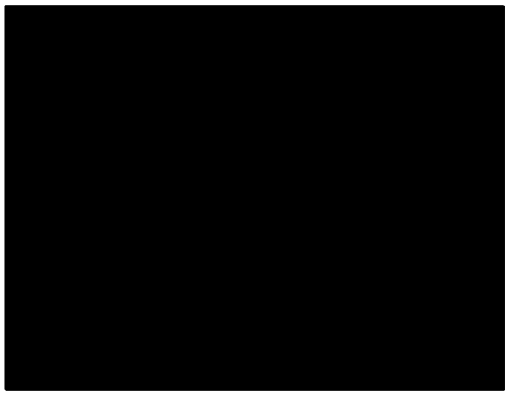
FIG. 5B (Prior Art)
FIG. 5B is a schematic view of a black frame displayed by the electrophoretic display of FIG. 1 at a second time.
Figure 5C:
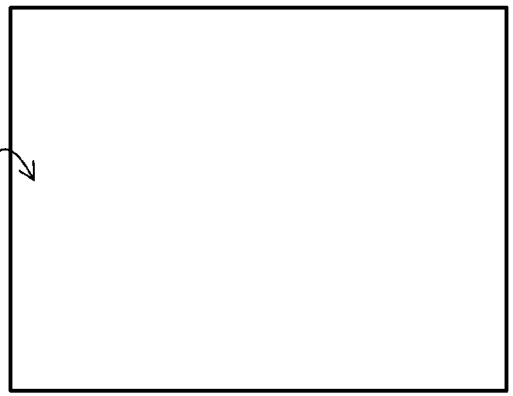
FIG. 5C (Prior Art)
FIG. 5C is a schematic view of a white frame displayed by the electrophoretic display of FIG. 1 at a third time.
Figure 5D:
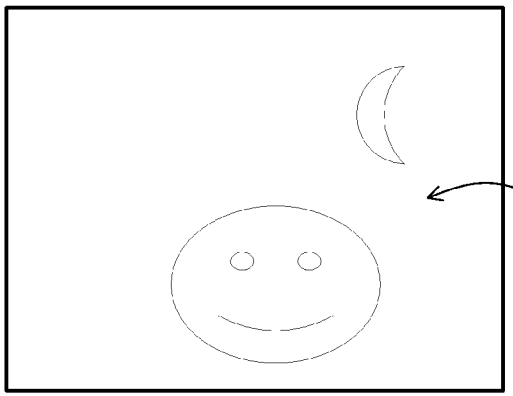
FIG. 5D (Prior Art)
FIG. 5D is a schematic view of a second frame displayed by the electrophoretic display of FIG. 1 at a fourth time.
Figure 6:
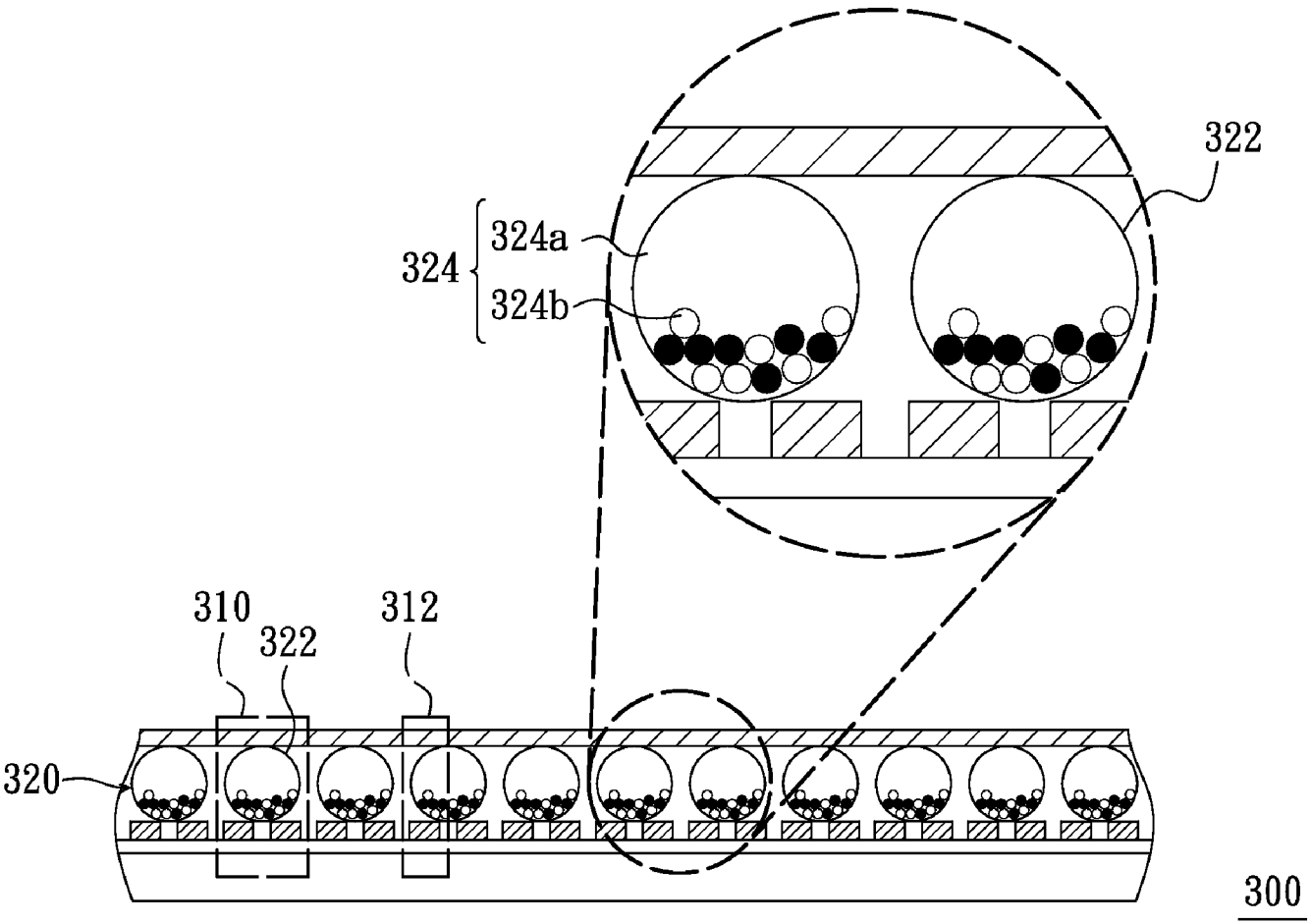
FIG. 6 is a schematic cross-sectional view of an electro-optic display in accordance with an embodiment of the present invention.
Figure 7:
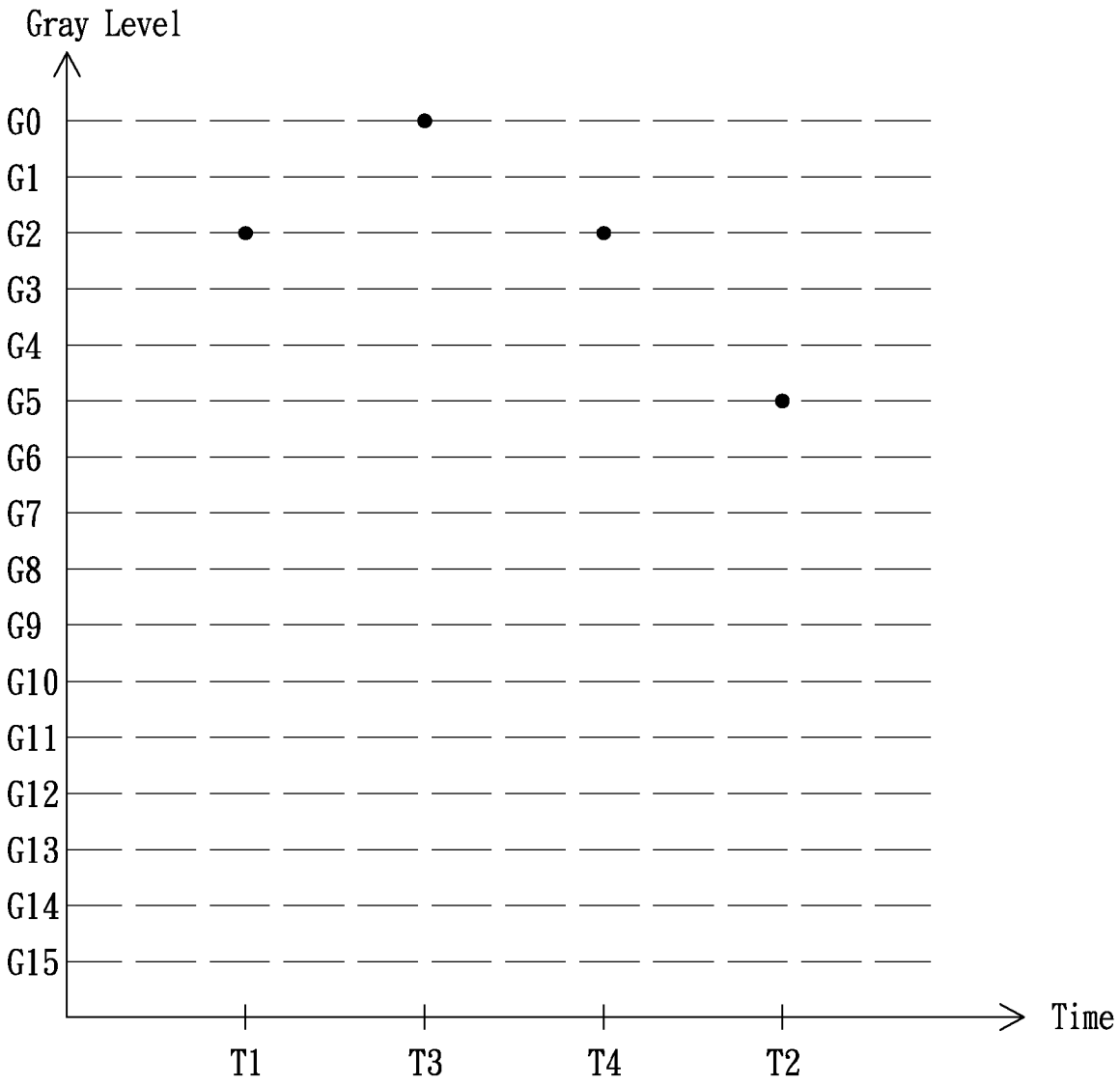
FIG. 7 is a schematic view of different gray levels shown by one of the pixels of F*igure* 6 at different times.
Figure 8:
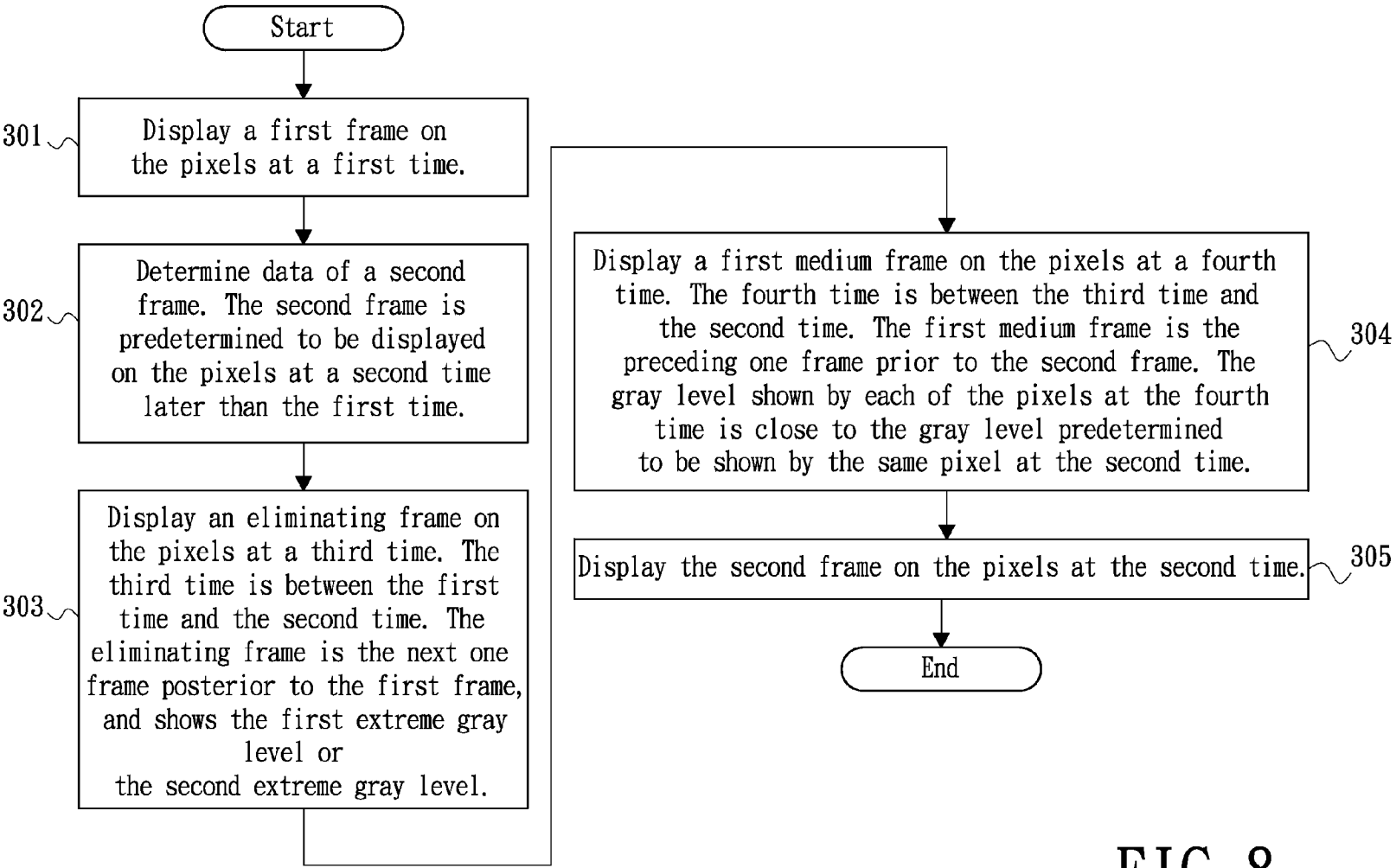
FIG. 8 is a flow chart of a method of driving the electro-optic display in accordance with the present embodiment.

FIG. 6 is a schematic cross-sectional view of an electro-optic display in accordance with an embodiment of the present invention. FIG. 7 is a schematic view of different gray levels shown by one of the pixels of FIG. 6 at different times. FIG. 8 is a flow chart of a method of driving the electro-optic display of the present embodiment. Referring to FIG. 6, the electro-optic display 300 comprises a plurality of pixels 310 adapted to displaying frames. The electro-optic display 300 may be a bistable electro-optic display, such as an electrophoretic display.

An electrophoretic layer 320 of the electro-optic display 300 such as the electrophoretic display comprises a plurality of microcapsules 322 and the electrophoretic fluid 324 filling in each of the microcapsules 322. The electrophoretic fluid 324 filling in each of the microcapsules 322 comprises the dielectric solvent 324*a* and a plurality of charged pigment particles 324*b* dispersed in the dielectric solvent 324*a*. It should be noted that the microcapsules 322 of the present embodiment may be replaced by a plurality of microcups. Furthermore, one side of each of the charged pigment particles 324*b* may be white and another side thereof may be black. The scope of the present invention is not limited herein.

For the convenience of illustration, FIG. 7 only shows the different gray levels shown by one of the pixels 310 at different times. Referring to FIGS. 6 and 7, each of the pixels 310 of the electro-optic display 300 is adapted to displaying a plurality of gray levels G0 to G15. In other words, the amount of the gray levels of the electro-optic display 300 is 16. In specific, in the present embodiment, each of the pixels 310 includes four sub-pixels 312 and each of the sub-pixels 312 may display black or white, so each of the pixels 310 can display 24 gray levels. In addition, the amount of the gray levels of the electro-optic display 300 of the present embodiment may be a multiple of 4. That is, the amount of the gray levels of the electro-optic display 300 is 4N, and N is a positive integer. In the present embodiment, N is 4. It should be noted that the amount of the gray levels of the electro-optic display 300 of the present embodiment is given as an example, and the scope of the present invention is not limited herein.

A group composed of the gray levels G0 to G15 includes a first extreme gray level (such as black), a plurality of intermediate gray levels G1 to G14, and a second extreme gray level (such as white). In other words, the gray levels G0 to G15 are from the deep to the light. It should be noted that in another embodiment, the first extreme gray level G0 may be deep blue, and the intermediate gray levels G1 to G14 may be pale blue with different degrees.

The method of driving the electro-optic display of the present embodiment is described in the following. Referring to FIGS. 6, 7 and 8, the method of driving the electro-optic display of the present embodiment includes the following steps. Firstly, the step 301 is performed. The step 301 is that a first frame is displayed on the pixels 310 at a first time T1. According to FIG. 7, one of the pixels 310 shows the gray level G2 at the first time T1. Since each of the pixels 310 shows a specific gray level at the first time T1, the first frame can be displayed such that the user receive the information related to the first frame when the user view a display screen (not shown) of the electro-optic display 300.

Then, the step 302 is performed. The step 302 is that data of a second frame is determined. The second frame is predetermined to be displayed on the pixels 310 at a second time T2, and the second time T2 is later than the first time T1. In the present embodiment, the user can input a switching instruction to the electro-optic display 300 in order to switch from the first frame to the second frame. At this time, the data of the second frame can be determined.

Next, the step 303 is performed. The step 303 is that an eliminating frame is displayed on the pixels 310 at a third time T3. The third time T3 is between the first time T1 and the second time T2. The eliminating frame is the next one frame posterior to the first frame, and the eliminating frame shows the first extreme gray level G0. In specific, after the user input the switching instruction to the electro-optic display 300, the display screen of the electro-optic display 300 is switched from displaying the first frame to displaying the eliminating frame such that the first frame is eliminated. At this time, all of the pixels 310 show the first extreme gray level G0 at the third time T3.

Afterwards, the step 304 is performed. The step 304 is that a first medium frame is displayed on the pixels 310 at a fourth time T4. The fourth time T4 is between the third time T3 and the second time T2. The first medium frame is the preceding one frame prior to the second frame. The gray level shown by each of the pixels 310 at the fourth time T4 is close to the gray level predetermined to be shown by the same pixel 310 at the second time T2. According to FIG. 7, one of the pixels 310 shows the gray level G2 at the fourth time T4, and the same pixel 310 is predetermined to show the gray level G5 at the second time T2.

It should be noted that in the present embodiment, the gray level shown by each of the pixels 310 at the fourth time T4 is one of the preceding N levels or one of the next N levels from the gray level shown by the same pixel 310 at the second time T2. According to FIG. 7, the pixel 310 is predetermined to show the gray level G5 at the second time T2, and thus the pixel 310 at the fourth time T4 can show one of the preceding four levels or one of the next four levels from the gray level G5. In other words, the pixel 310 at the fourth time T4 can show one of the gray levels G1, G2, G3, G4, G6, G7, G8 and G9. It should be noted that if the pixel 310 is predetermined to show the gray level G0 at the second time T2, the pixel 310 at the fourth time T4 can show one of the gray levels G1, G2, G3 and G4. However, the above mentioned is not shown in the figures.

Afterwards, the step 305 is performed. The step 305 is that the second frame is displayed on the pixels 310 at the second time T2. According to FIG. 7, one of the pixels 310 shows the gray level G5 at the second time T2. Since each of the pixels 310 shows a specific gray level at the second time T2, the second frame can be displayed.

From the above description it can be seen that since the gray level shown by each of the pixels 310 at the fourth time T4 is close to the gray level predetermined to be shown by the same pixel 310 at the second time T2, compared with the conventional art, the method of driving the electro-optic display of the present embodiment can reduce the user's uncomfortable feel related to the extreme twinkle during switching from the first frame to the second frame.

Figure 9:
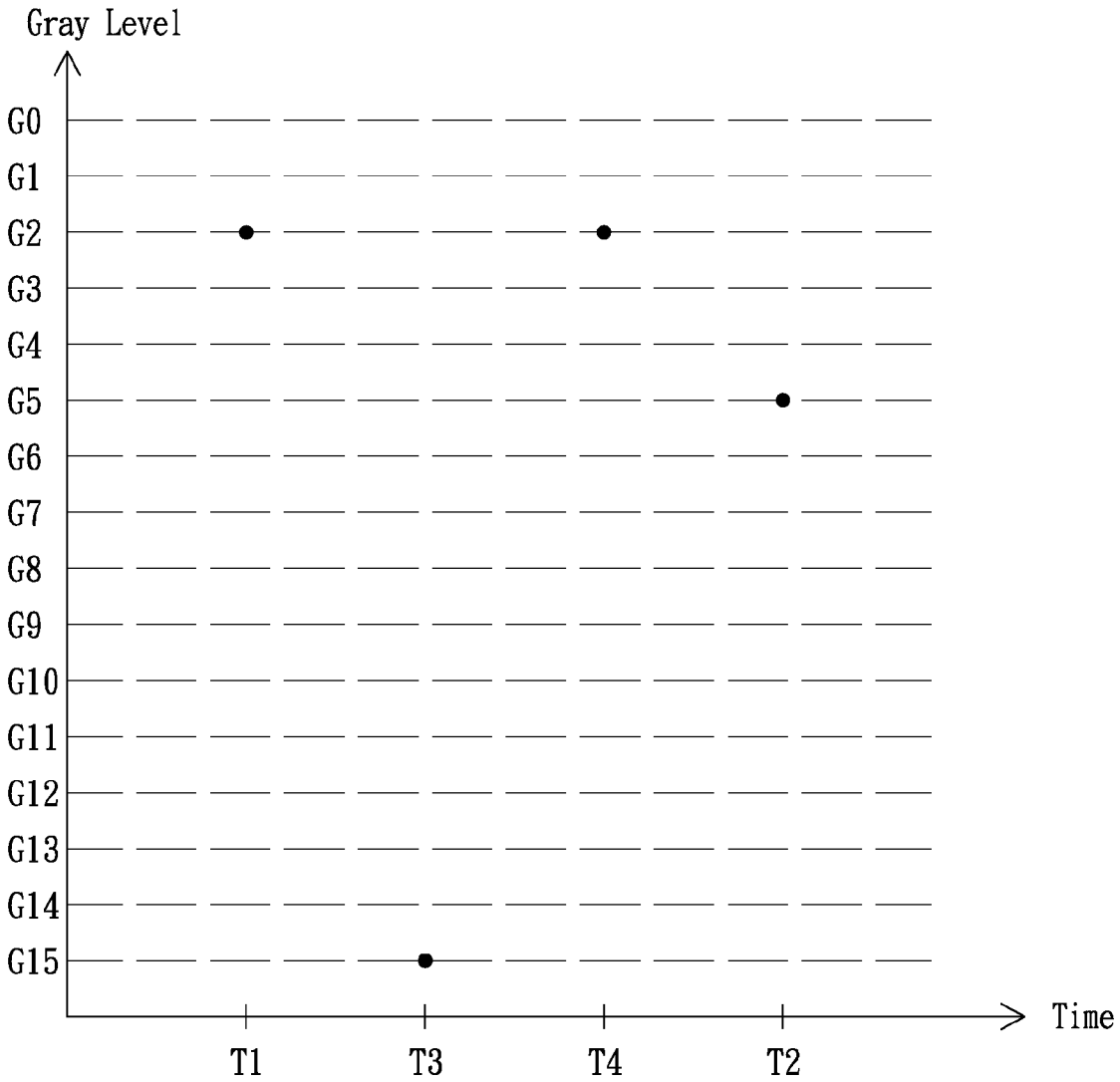
FIG. 9 is a schematic view of different gray levels shown by one of the pixels at different times in accordance with another embodiment of the present invention.

FIG. 9 is a schematic view of different gray levels shown by one of the pixels at different times in accordance with another embodiment of the present invention. For the convenience of illustration, FIG. 9 only shows the different gray levels shown by one of the pixels (as shown in FIG. 6) at the different times. Referring to FIG. 9, the difference between the method of driving the electro-optic display of the present embodiment and that of the above embodiment lies in that in the present embodiment, the eliminating frame displayed at the third time T3 shows the second extreme gray level G15.

In summary, the pixel 310 (as shown in FIG. 6) used as an example of the present embodiment shows the gray levels G2, G15, G2 and G5 at the times T1, T3, T4 and T2 respectively, which represents an oscillatory trend. In other words, the gray level G2 shown by the pixel 310 (as shown in FIG. 6) at the first time T1 is converted into the gray level G5 shown by the same pixel 310 at the second time T2 by means of a mode of oscillatory approaching.

Figure 10:
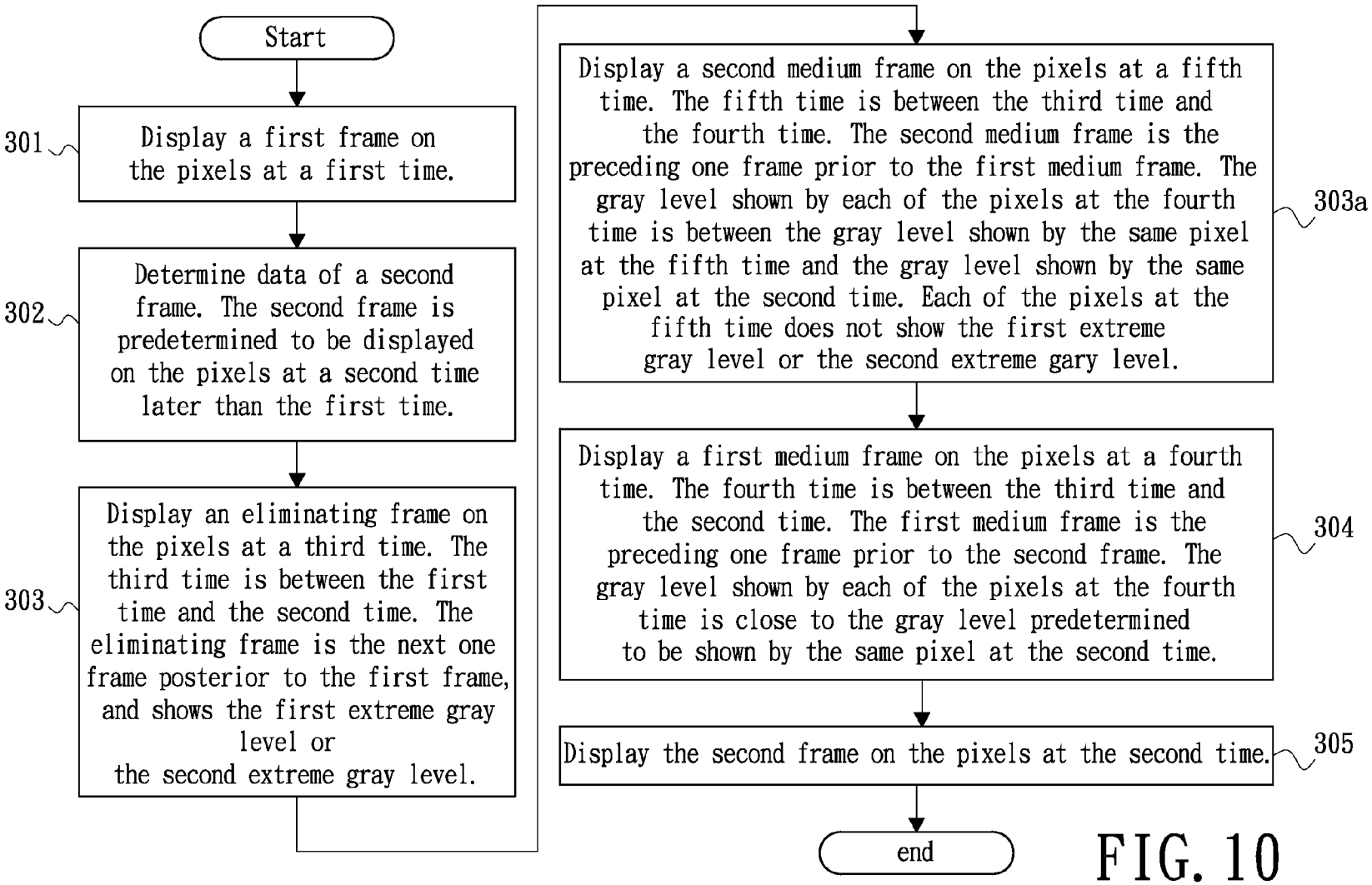
FIG. 10 is a flow chart of a method of driving the electro-optic display in accordance with another embodiment of the present invention.
Figure 11:
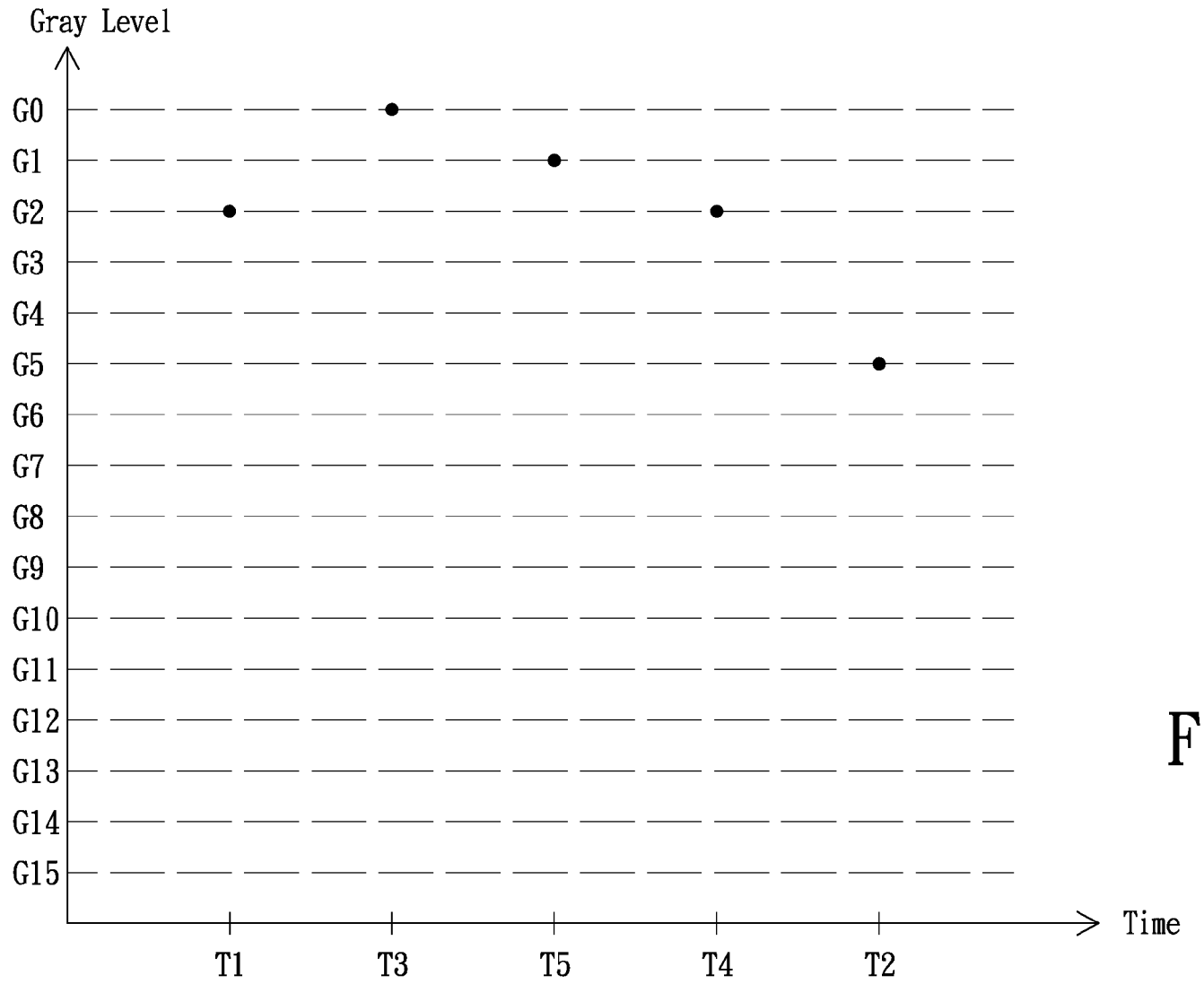
FIG. 11 is a schematic view of different gray levels shown by one of the pixels of FIG. 6 at different times.

FIG. 10 is a flow chart of a method of driving the electro-optic display in accordance with another embodiment of the present invention. FIG. 11 is a schematic view of different gray levels shown by one of the pixels of FIG. 6 at different times. Referring to FIGS. 10 and 11, the difference between the method of driving the electro-optic display of the present embodiment and that of the above embodiment lies in that the method of driving the electro-optic display of the present embodiment further comprises the following step 303*a*. The step 303*a* is that a second medium frame is displayed on the pixels 310 (as shown in FIG. 6) at a fifth time T5. The fifth time T5 is between the third time T3 and the fourth time T4. The second medium frame is the preceding one frame prior to the first medium frame. The gray level shown by each of the pixels 310 at the fourth time T4 is between the gray level shown by the same pixel 310 at the fifth time T5 and the gray level predetermined to be shown by the same pixel 310 at the second time T2. In addition, each of the pixels 310 (as shown in FIG. 6) at the fifth time T5 does not show the first extreme gray level G0 or the second extreme gray level G15.

According to FIG. 11, one of the pixels 310 (as shown in FIG. 6) shows the gray level G1 at the fifth time T5, the same pixel 310 shows the gray level G2 at the fourth time T4, and the same pixel 310 shows the gray level G5 at the second time T2. In other words, from the fifth time T5 to the second time T2, the gray level GI shown by the pixel 310 (as shown in FIG. 6) is converted gradually into the gray level G5 shown by the same pixel 310.

Figure 12:
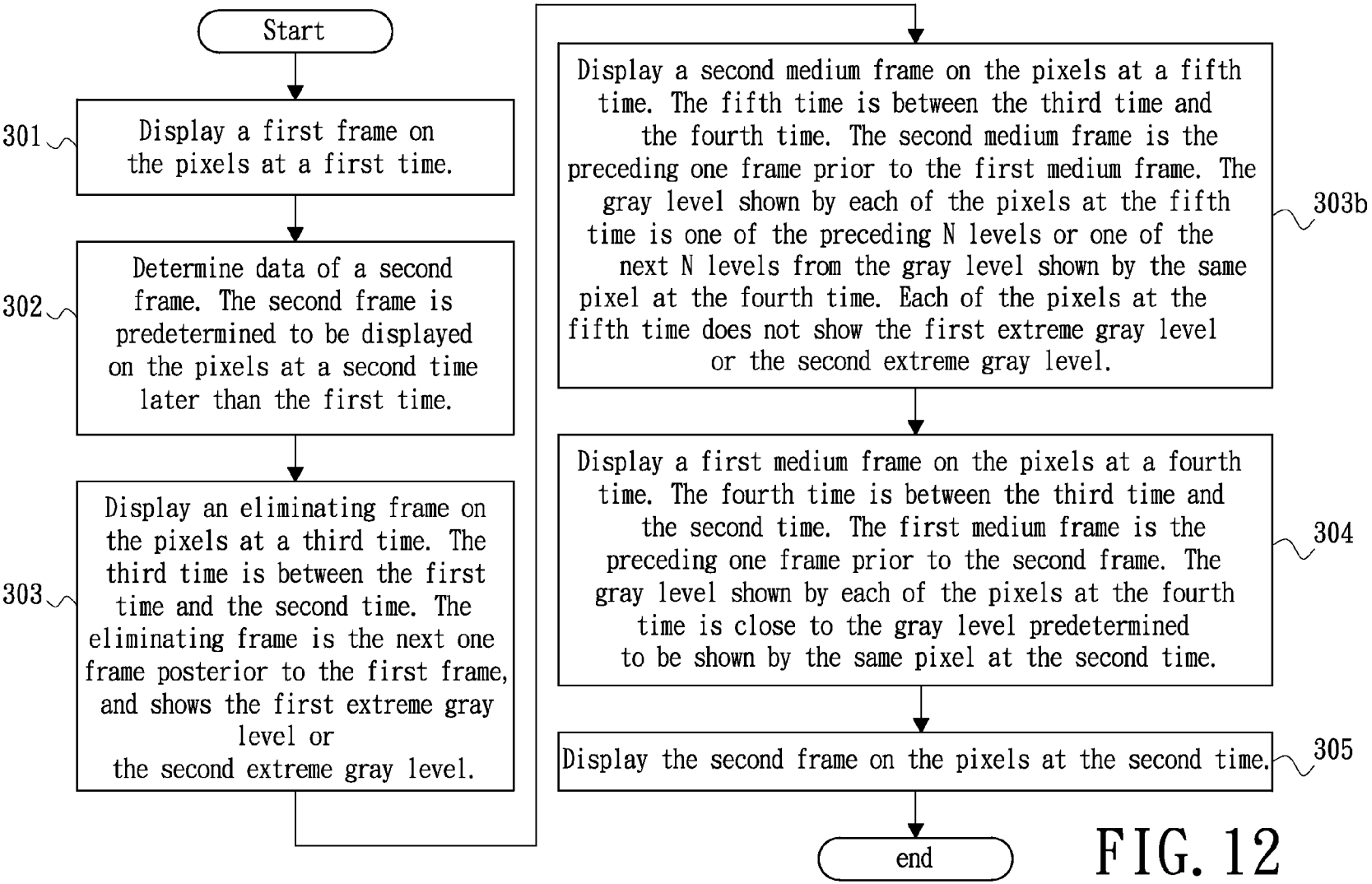
FIG. 12 is a flow chart of a method of driving the electro-optic display in accordance with another embodiment of the present invention.
Figure 13:
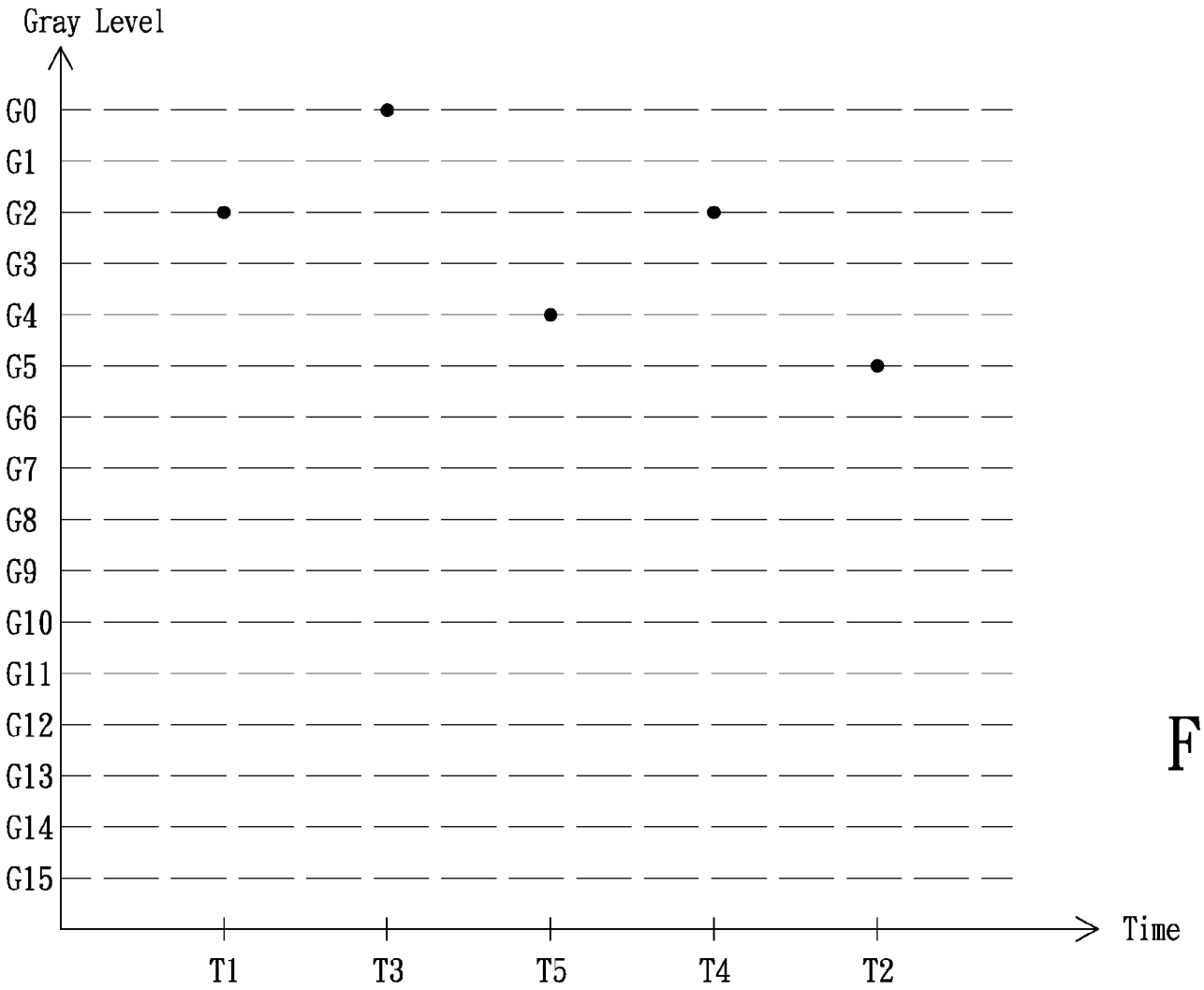
FIG. 13 is a schematic view of different gray levels shown by one of the pixels of FIG. 6 at different times.

FIG. 12 is a flow chart of a method of driving the electro-optic display in accordance with another embodiment of the present invention. FIG. 13 is a schematic view of different gray levels shown by one of the pixels of FIG. 6 at different times. Referring to FIGS. 12 and 13, the difference between the method of driving the electro-optic display of the present embodiment and that of the above embodiment lies in that the method of driving the electro-optic display of the present embodiment further comprises the following step 303b. The following step 303b is that another second medium frame is displayed on the pixels (as shown in FIG. 6) at the fifth time T5. The fifth time T5 is between the third time T3 and the fourth time T4. The second medium frame is the preceding one frame prior to the first medium frame. The gray level shown by each of the pixels 310 (as shown in FIG. 6) at the fifth time T5 is one of the preceding N levels or one of the next N levels from the gray level shown by the same pixel 310 (as shown in FIG. 6) at the fourth time T4. In addition, each of the pixels 310 (as shown in FIG. 6) at the fifth time T5 does not show the first extreme gray level GO or the second extreme gray level G15.

According to FIG. 13, one of the pixels 310 (as shown in FIG. 6) at the fifth time T5 can show the gray level G1, the gray level G3, the gray level G4, the gray level G5 or the gray level G6. The pixel 310 (as shown in FIG. 6) of the present embodiment shows the gray level G4 at the fifth time T5. In summary, the gray level G2 shown by the pixel 310 (as shown in FIG. 6) at the first time T1 is converted into the gray level G5 shown by the same pixel 310 at the second time T2 by means of a mode of oscillatory approaching.

In summary, the method of driving the electro-optic display of each of the embodiments of the present invention at least includes one of the following advantages or other advantages. Since the gray level shown by each of the pixels at the fourth time is close to the gray level predetermined to be shown by the same pixel at the second time, compared with the conventional art, the method of driving the electro-optic display of each of the embodiments can reduce the user's uncomfortable feel related to the extreme twinkle during switching from the first frame to the second frame.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of driving an electrophoretic display, wherein the electrophoretic display has a plurality of pixels, each of the pixels is adapted to displaying a plurality of gray levels, and a group composed of the gray levels includes a deepest gray level, a plurality of intermediate gray levels and a lightest gray level, the method of driving the electrophoretic display comprising:

displaying a first frame on the pixels at a first time;

determining data of a second frame, wherein the second frame is predetermined to be displayed on the pixels at a second time, and the second time is later than the first time;

displaying an eliminating frame at a third time, wherein the third time is between the first time and the second time, the eliminating frame is the next one frame posterior to the first frame, and the eliminating frame shows the deepest gray level or the lightest gray level on all the pixels;

displaying a first medium frame at a fourth time, wherein the fourth time is between the third time and the second time, the first medium frame is the preceding one frame prior to the second frame, and the gray level shown by each of the pixels at the fourth time is close to the gray level predetermined to be shown by the same pixel at the second time; and displaying the second frame on the pixels at the second time, thereby a ghost image of the first frame appears at the second frame is avoided and uncomfortable feeling during switching from the first frame to the second frame is reduced.

2. The method of driving the electrophoretic display as claimed in claim 1, wherein the amount of the pixels is 4N, N is a positive integer, and the gray level shown by each of the pixels at the fourth time is one of the preceding N levels or one of the next N levels from the gray level shown by the same pixel at the second time.

3. The method of driving the electrophoretic display as claimed in claim 2, further comprising:

displaying a second medium frame on the pixels at a fifth time, wherein the fifth time is between the third time and the fourth time, the second medium frame is the preceding one frame prior to the first medium frame, the gray level shown by each of the pixels at the fifth time is one of the preceding N levels or one of the next N levels from the gray level shown by the same pixel at the fourth time, and each of the pixels at the fifth time does not show the deepest gray level or the lightest gray level.

4. The method of driving the electrophoretic display as claimed in claim 1, further comprising:

displaying a second medium frame on the pixels at a fifth time, wherein the fifth time is between the third time and the fourth time, the second medium frame is the preceding one frame prior to the first medium frame, the gray level shown by each of the pixels at the fourth time is between the gray level shown by the same pixel at the fifth time and the gray level shown by the same pixel at the second time, and each of the pixels at the fifth time does not show the deepest gray level or the lightest gray level.

* * * * *